US005928023A

United States Patent [19]

Buckner et al.

[11] Patent Number: 5,928,023

[45] Date of Patent: Jul. 27, 1999

[54] ELECTRICAL POWER PLUG RETAINER

[76] Inventors: Gregory W. Buckner, 8343 Yearling Way, Riverside; Raymond Patton, 1129 Birch St., Santa Ana, both of Calif. 92707

[21] Appl. No.: 08/752,670

[22] Filed: Nov. 19, 1996

Related U.S. Application Data

[62] Division of application No. 08/349,803, Dec. 6, 1994, Pat. No. 5,575,677.

[51] Int. Cl.[6] ..... H01R 13/62

[52] U.S. Cl. ..... 439/373; 439/371

[58] Field of Search ..... 439/371, 373, 439/148, 149, 147, 367–370

[56] References Cited

U.S. PATENT DOCUMENTS

| | | | |
|---|---|---|---|
| 4,618,200 | 10/1986 | Roberts et al. | 439/367 |
| 4,618,740 | 10/1986 | Ray et al. | 439/148 |
| 4,652,069 | 3/1987 | Smith | 439/370 |
| 4,840,577 | 6/1989 | Prouty | 439/373 |
| 5,011,427 | 4/1991 | Martin | 439/373 |
| 5,026,300 | 6/1991 | Varner | 439/371 |
| 5,211,573 | 5/1993 | Cross | 439/369 |

*Primary Examiner*—Hien Vu
*Attorney, Agent, or Firm*—James M. Deimen

[57] ABSTRACT

A new power plug retainer comprises a cubical or rectangular parallelepiped box having an open side and open end. Opposite the open end is a slot terminating at the open side. Outwardly extending to either side of the open end are a pair of flanges upon which a permanent or semi-permanent adhesive is coated. Optionally, a double adhesive sided foam tape may be attached to each side flange. A third outwardly extending flange may also be added to the open end adjacent the third side. This flange may also be coated with adhesive. The adhesive attachment is specifically directed to obviating the need for any mechanical fastening of the retainer to a plastic or metal cabinet or enclosure. Adjustability for different lengths of plugs is provided by an alternate version of the retainer comprising an open ended box telescopically engaging a second box with a partially closed end. The engagement includes retention means to positively retain the telescopic engagement of the two boxes. With either permanent or semi-permanent adhesive attachment the new retainer can be attached to metal or plastic cabinets without any breach of cabinet integrity.

6 Claims, 2 Drawing Sheets

ELECTRICAL POWER PLUG RETAINER

This is a divisional of application Ser. No. 08/349,803 filed on Dec. 6, 1994,now U.S. Pat. No. 5,575,677.

BACKGROUND OF THE INVENTION

The field of the invention pertains to the supply of electrical power to electric devices and, in particular, to the power cords that connect portable wheeled electric devices to wall sockets in a hospital setting. The power cords typically plug into both the wall sockets and into the backs of the portable devices. In a hospital setting the devices are frequently moved while plugged in and on occasion individuals walk behind the devices. Under such circumstances the power cords inadvertently become loosened and unplugged from the device.

With the advent of micro-computers the hospital devices have become very sophisticated. Lengthy and important tests are performed with the portable devices now employed. With inadvertent unplugging, the entire test can be lost, the device damaged or possibly the health of a patient jeopardized.

U.S. Pat. No. 2,722,665 discloses a safety guard to retain plugs to a wall socket. The guard comprises a slotted shield having flanges that fit behind the cover plate of the wall socket. Thus, the cover plate retains the guard in place and the plugs are trapped between the guard and the socket.

U.S. Pat. No. 3,491,327 discloses a safety cover also having flanges that fit behind the cover plate. This cover also traps the plugs between the cover and socket with the power cords passing out through an aperture in the bottom of the cover.

In U.S. Pat. No. 4,045,108 a spring device is fastened over the plugs and retained in place by the center screw of the socket cover plate. The power cords pass through slots between the resilient legs that retain the plugs.

U.S. Pat. Nos. 4,652,069 and 5,011,427 each disclose two piece adjustable retainers that fasten to the wall socket by the center screw of the socket cover plate. The adjustable retainer comprises a second slotted part that adjusts for the length of the plug along the cord.

As distinguished from the above devices which all are directed to wall sockets, U.S. Pat. No. 5,174,293 discloses a portable medical device rack on wheels with a variety of power cords plugged into the back of devices in the rack. Disclosed are a variety of shaped metal retainers to prevent the power cords from becoming unplugged from the devices. The retainers utilize screws or a variety of mechanical fastening means built into the device cabinet to prevent the retainers and plugs from detachment. Thus, these retainers require the cabinets to be specially equipped for the matching retainers.

Most medical device cabinets do not provide any specific means to attach retainers for the power cords. In addition, with many sophisticated devices the manufacturers' warranty is voided if the cabinet integrity is violated by drilling holes for screws in the cabinet back. Thus, the applicant's new retainer as disclosed below is directed to a universal device that does not violate cabinet integrity.

SUMMARY OF THE INVENTION

The new retainer comprises a cubical or rectangular parallelepiped box having an open side and open end. Opposite the open end is a slot terminating at the open side. Outwardly extending to either side of the open end are a pair of flanges upon which a permanent or semi-permanent adhesive is coated. Optionally, a double adhesive sided foam tape may be attached to each side flange. The foam tape provides for a good adhesive bond despite irregularities such as rivet heads on the cabinet adjacent the socket. A third outwardly extending flange may also be added to the open end adjacent the third closed side. Two versions of this retainer are appropriate to accommodate most portable wheeled electric devices used in hospital settings. In addition to the first version above, the second version of the retainer substitutes an open bottom for the open side with the slot terminating at the open bottom. Although descriptively similar the proportions of each version differ distinctively.

Adjustability for different lengths of plugs is provided by an alternate two piece version of the retainer comprising an open ended box telescopically engaging a second box with a partially closed end. The engagement includes retention means to positively retain the telescopic engagement of the two boxes. This alternate version of the retainer is better suited for permanent adhesive attachment to the cabinet.

With either permanent or semi-permanent adhesive attachment the new retainer can be attached to metal or plastic cabinets without any breach of cabinet integrity.

DESCRIPTION OF THE PREFERRED EMBODIMENTS

Figure 1A:
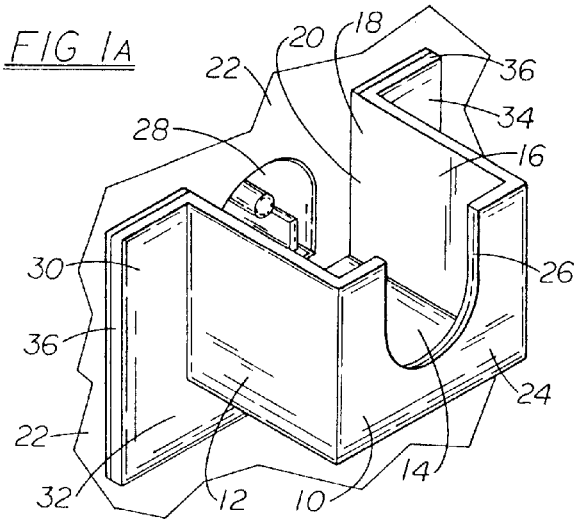
FIG. 1*a* is a perspective view of a first version of the new retainer.
Figure 2A:
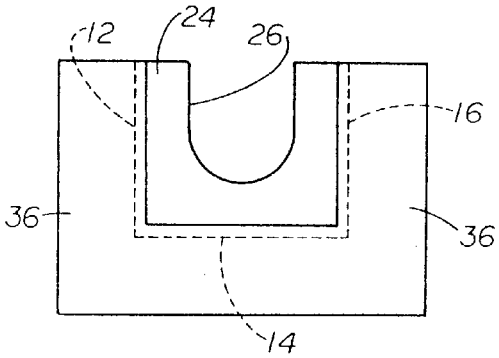
FIG. 2*a* is a back view of the new retainer of FIG. 1*a;*

Illustrated in FIGS. 1*a* and 2*a* is the new retainer comprising a hollow body 10 of generally rectangular, parallelepiped shape. The hollow body 10 includes a pair of sidewalls 12, 16 and a bottom wall 14, the fourth sidewall 18 being open as shown. The end wall 20 toward the cabinet back 22 likewise is open. Opposite the end wall 20 is a closed end wall 24 having a slot 26 open to the open sidewall 18. The slot 26 is sized smaller than the diameter of a plug engaged with the recessed socket 28 in the cabinet back 22.

About the open end wall 20 are three flanges 30, 32 and 34 extending from the three sidewalls 12, 14 and 16, respectively. Coated on the back side of each of the flanges 30, 32 and 34 is an adhesive 36 that permanently or semi-permanently attaches the retainer to the cabinet wall 22 about the socket 28. Prior to installation the adhesive 36 is covered with wax paper or other means to prevent adhesive attachment to anything prior to installation. Preferably, the flanges 30, 32 and 34 are extended beyond the sidewalls 12, 14 and 16 an amount substantially beyond the distance necessary for most applications. The flanges 30, 32 and 34 can thereby be trimmed as needed for each application while retaining the maximum adhesive area possible for each application.

Figure 1B:
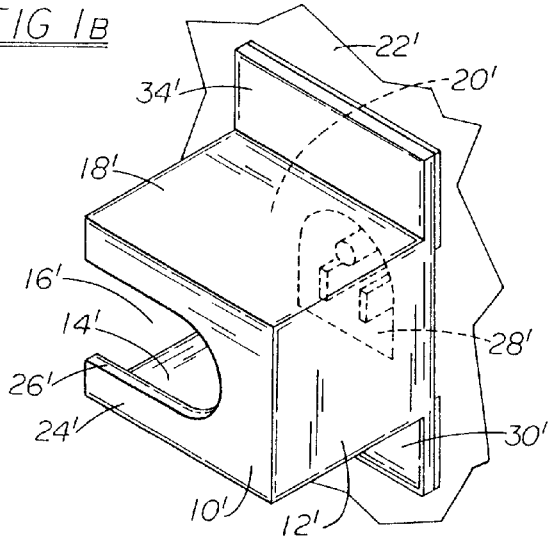
FIG. 1*b* is a perspective view of a second version of the new retainer.
Figure 2B:
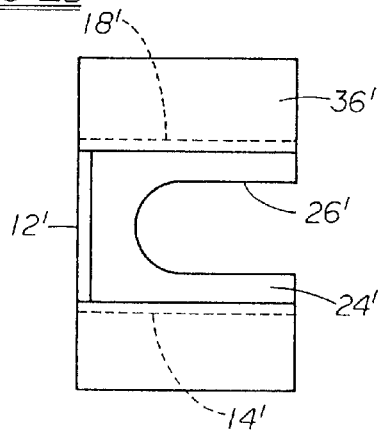
FIG. 2*b* is a back view of the new retainer of FIG. 1*b;*

Illustrated in FIGS. 1*b* and 2*b* is the second version of the new retainer comprising a hollow body 10' of generally rectangular, parallelpiped shape, however, being of relatively tall and narrow proportions in comparison with the first version and having sidewall 16' open rather than sidewall 18'. Sidewall 12' and sidewall 14' remain closed. The end wall 20' toward the cabinet back 22' remains open. Opposite the end wall 20' is a closed end wall 24' having a slot 26' open leftwardly to the open sidewall 16'. As above, the slot 26' is sized smaller than the diameter of a plug engaged in the recessed socket 28' in the cabinet back 22'.

To each side of the open end wall 20' are flanges 30' and 34' extending from the sidewalls 14' and 18'. As above, coated on the back side of each of the flanges 30' and 34' is an adhesive 36' that permanently or semi-permanently attaches the retainer to the cabinet wall 22' about the recessed socket 28'. The flanges 30' and 34' are preferably oversize and the adhesive covered with wax paper prior to use.

As an alternative attachment a double sided foam tape having adhesive on both sides may be used as the adhesive coating 36 or 36'. The foam tape can accommodate small irregularities in the cabinet back 22 or 22' such as rivet and screw heads thereby assuring that there is a full solid attachment of the flanges 30, 32 and 34 or 30' or 34' to the cabinet.

Figure 1C:
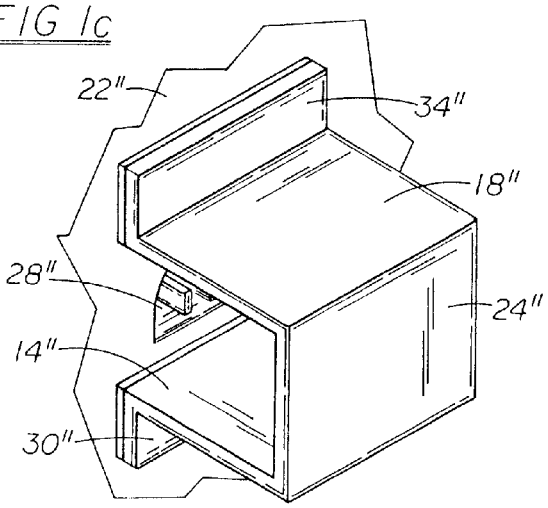
FIG. 1*c* is a perspective view of a third version of the new retainer.
Figure 2C:
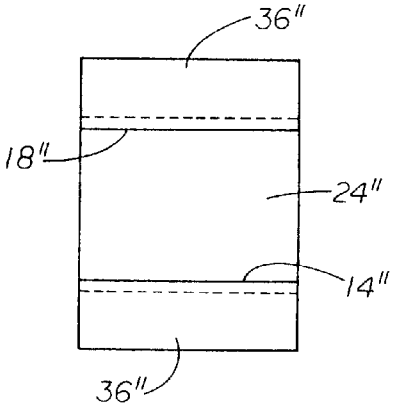
FIG. 2*c* is a back view of the new retainer of FIG. 1*c;*

A third version of the new retainer is shown in FIGS. 1*c* and 2*c* wherein a hollow body 10" comprises two opposite sidewalls 14" and 18" with appended flanges 30" and 34", respectively. The sidewalls 14" and 18" are joined by end wall 24" spaced from the cabinet back 24" by the sidewalls. As above an adhesive or double sided adhesive tape 36" is applied to the flanges 30" and 34" for attachment to the cabinet back 22" to either side of the recessed socket 28". This particular retainer is particularly suitable for "L-shaped" plug and cable units. Moreover, the hollow body 10" may be very economically produced from an extruded plastic shape.

Figure 3:
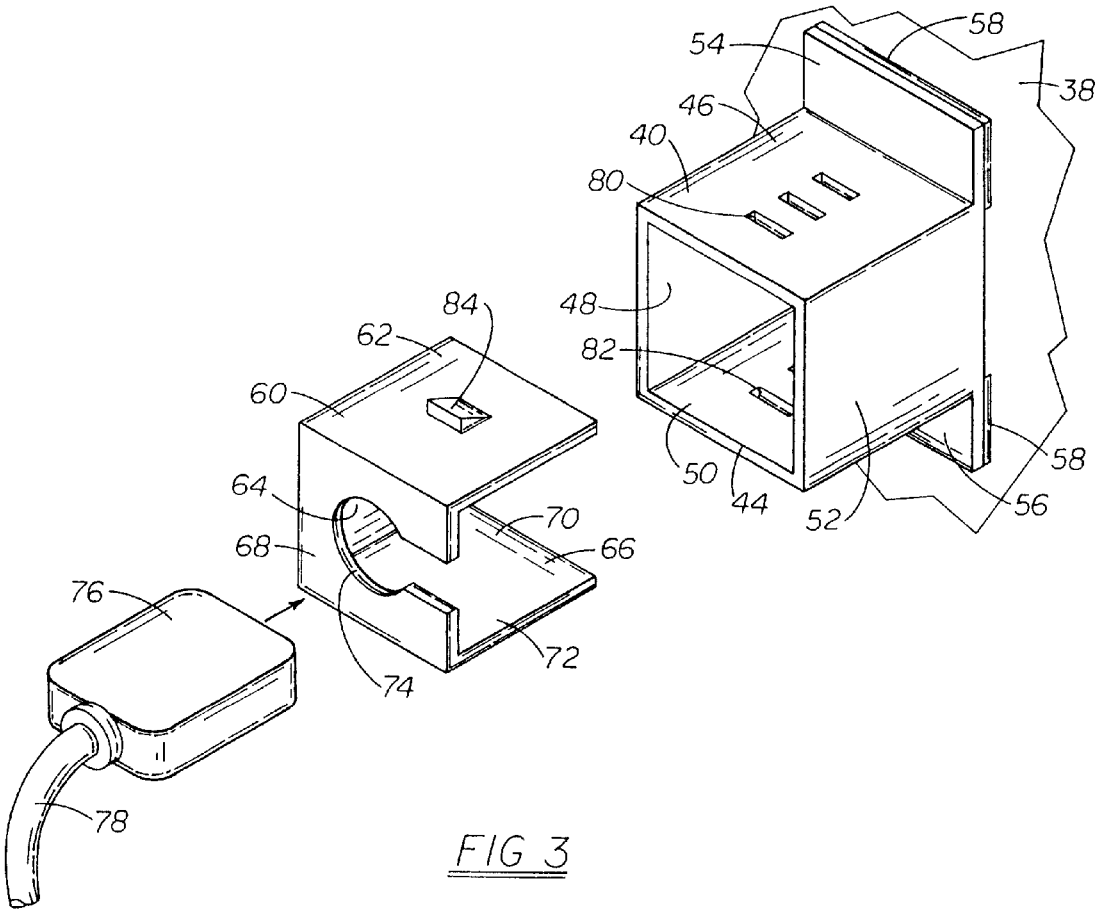
FIG. 3 is an exploded perspective view of an alternate two piece version of the new retainer.
Figure 4:
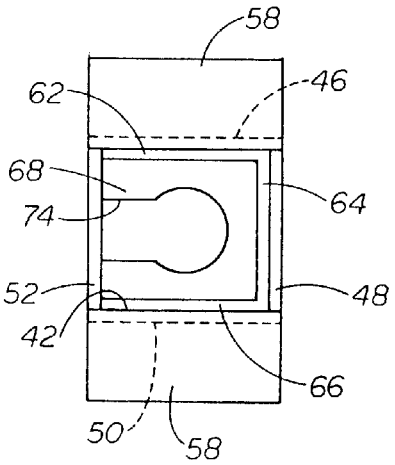
FIG. 4 is a back view of the alternate version of the new retainer.

Illustrated in FIGS. 3 and 4 is an alternate version of the new retainer shown attached to a cabinet back 38. The retainer comprises a first hollow body 40 of rectangular parallelepiped shape having both end walls 42 and 44 open. Four sidewalls 46, 48, 50 and 52 surround the open ends 42 and 44 to form the body 40. Extending from upper 46 and lower 50 sidewalls are a pair of flanges 54 and 56. Applied to the back sides of the flanges 54 and 56 is an adhesive coating 58 or double coated foam tape as above which attaches the hollow body 40 to the cabinet back 38.

A second hollow body 60 of rectangular parallelepiped shape is telescopically engageable with the first hollow body 40. The second hollow body 60 comprises three sidewalls 62, 64 and 66 and an end wall 68 with the opposite end wall 70 and fourth sidewall 72 open. A keyhole slot 74 opens to the open fourth sidewall 72 to permit a plug 76 to be positioned in the body 60 with the cord 78 extending through the keyhole slot 74. With the second hollow body 60 and plug 76 therein telescoped within first hollow body 40, the plug 76 is retained to the cabinet back 38.

To assure that the hollow bodies 40 and 60 are retained together and provide some adjustability, a plurality of small rectangular slots 80 and 82 are formed in the upper 46 and lower 50 sidewalls of the first hollow body 40. Formed in the upper 62 and lower 66 sidewalls of the second hollow body 60 are small, flexible protrusions 84 adapted to snap into the slots 80 and 82 upon engagement of the hollow bodies thus providing positive retention means. To release the protrusions 84 from the slots 80 and 82 the tip of a screw driver need only be inserted.

As an example of the actual size of the first version (FIGS. 1*a* and 2*a*) of the retainer, the depth from the open end wall 20 to the closed end wall 24 is 1.125 inches. The closed end wall 24 is 1.264 by 0.882 inches on the exterior. The sidewall and end wall thickness is 0.125 inches. The flanges 30, 32 and 34 extend preferably about 0.5 inches beyond the sidewalls 12, 14 and 16, respectively. In this example more than three square inches of adhesive surface for secure attachment are available.

We claim:

1. An electric power plug retainer comprising a first hollow body directly attachable to a cabinet about a power plug socket and a second hollow body, said first hollow body being substantially parallelepiped having four sidewalls and open opposite ends, said second hollow body having one second open end and being telescopically engageable with the first hollow body;

at least one flange extending from a sidewall of the first hollow boy adjacent one of said open opposite ends thereof, an adhesive coating on the flange, said adhesive coating adapted for attachment to said cabinet about said power plug socket, said second hollow body having a closed end located opposite the open end and an opening in a sidewall of the second hollow body extending from the second open end to the closed end, said first and second hollow bodies telescopically engageable in a direction perpendicular to said closed end, and a slot in the closed end for retaining a plug therein, said slot terminating at the opening in the sidewall of the second hollow body.

2. The electric power plug retainer of claim 1 including means to retain the first and second hollow bodies telescopically engaged.

3. The electric power plug retainer of claim 2 including means to permit manual release of the retention means of the telescopic engagement.

4. The electric power plug retainer of claim 1 wherein the second hollow body is substantially a parallelepiped having three sidewalls and the opening in the sidewall of the second hollow body comprises substantially an entire fourth sidewall.

5. The electric power plug retainer of claim 1 wherein at least two flanges extend from at least two sidewalls at the same open end of the first hollow body, said adhesive coating being on the flanges that extend from the sidewalls of the first hollow body.

6. The electric power plug retainer of claim 1 wherein the adhesive coating comprises foam tape adhesively attached to the flange and having an exposed adhesive coating for attachment to a cabinet.

* * * * *